United States Patent [19]

Sato et al.

[11] Patent Number: 4,738,594

[45] Date of Patent: Apr. 19, 1988

[54] BLADES FOR AXIAL FANS

[75] Inventors: Shojiro Sato, Yokohama; Yukio Shinozaki, Funabashi; Toshikazu Murayama; Takenobu Shima, both of Yokohama; Takuo Ueno, Matsudo, all of Japan

[73] Assignee: Ishikawajima-Harima Jukogyo Kabushiki Kaisha, Japan

[21] Appl. No.: 826,328

[22] Filed: Feb. 5, 1986

[51] Int. Cl.[4] ..... F04D 29/38

[52] U.S. Cl. ..... 416/224; 416/213 A

[58] Field of Search ..... 416/213 A, 224, 226; 415/214

[56] References Cited

U.S. PATENT DOCUMENTS

| | | | |
|---|---|---|---|
| 2,183,158 | 12/1939 | Bennett | 416/226 X |
| 2,389,760 | 11/1945 | Brierley | 416/224 |
| 2,482,936 | 9/1949 | Renoux | 416/226 |
| 2,574,980 | 11/1951 | Meyers | 416/226 |
| 2,884,077 | 4/1959 | Stamm et al. | 416/226 |
| 3,123,144 | 3/1964 | Stulen et al. | 416/226 |
| 3,200,477 | 8/1965 | Shultz | 416/226 X |
| 3,237,697 | 3/1966 | Ford et al. | 416/226 |
| 3,275,295 | 9/1966 | Caldwell et al. | 416/224 |
| 3,333,642 | 8/1967 | Kee | 416/226 |
| 3,426,965 | 2/1969 | Kulling | 416/224 |
| 3,476,625 | 11/1969 | Slivinsky et al. | 416/226 X |
| 3,552,881 | 1/1971 | Rogers et al. | 416/226 X |
| 3,561,886 | 2/1971 | Kreischer et al. | 416/224 |
| 3,660,882 | 5/1972 | Widowitz et al. | 416/224 X |
| 3,856,434 | 12/1974 | Hoffmann | 416/224 X |
| 4,010,530 | 3/1977 | Delgrosso et al. | 416/224 X |
| 4,318,672 | 3/1982 | Hansen | 416/224 |
| 4,342,542 | 8/1982 | Tan et al. | 416/224 |

FOREIGN PATENT DOCUMENTS

| | | | |
|---|---|---|---|
| 667086 | 10/1929 | France | 416/224 |
| 1192949 | 10/1959 | France | 416/224 |
| 381102 | 9/1932 | United Kingdom | 416/224 |
| 548414 | 10/1942 | United Kingdom | 416/224 |
| 939505 | 10/1963 | United Kingdom | 416/224 |
| 950434 | 2/1964 | United Kingdom | 416/224 |
| 1096294 | 12/1967 | United Kingdom | 416/224 |
| 284623 | 1/1971 | U.S.S.R. | 416/224 |

*Primary Examiner*—Everette A. Powell, Jr.

[57] ABSTRACT

A fan blade in which a leading edge piece made of a hard sintered product is attached to the leading edge of a fan blade main body over along substantially $\frac{3}{4}$ to $\frac{1}{4}$ from the tip thereof so that a useful life of the fan blade is prolonged.

12 Claims, 4 Drawing Sheets

BLADES FOR AXIAL FANS

BACKGROUND OF THE INVENTION

The present invention relates to an improvement of blades of forced and induced draft fans for sucking and exhausting gases containing dust.

Easily worn are the blades of fans for sucking gases containing a large quantity of dust and discharging them as in the case of the gases discharged from coal-burned boilers. Wear at the leading edge of each blade extending about ¾-¼ in length thereof from the blade tip is especially pronounced and greatly influences a useful life of the blade. Therefore, there has been an increasing demand to take some countermeasures to minimize wear of the fan blades, thereby prolonging a useful life thereof.

In order to overcome the above described problem, there has been proposed and demonstrated a fan blade the leading edge of which is covered with a stainless-steel plate which in turn is plated with hard chrome.

With this construction of the fan blades, there arises the problem that hard chrome plating is limitative in thickness and prolongation of a useful life is extremely slight.

In view of the above, one of the objects of the present invention is to provide a fan blade a useful life of which is prolonged even when gases containing dust are handled.

The above and other objects, effects, features and advantages of the present invention will become more apparent from the following description of preferred embodiments thereof taken in conjunction with the accompanying drawings.

DETAILED DESCRIPTION OF THE PREFERRED EMBODIMENTS

Figure 1:
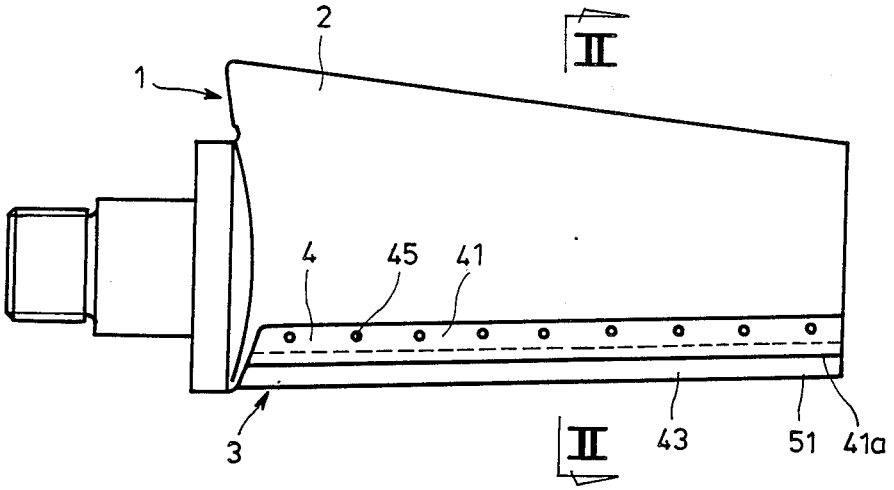
FIG. 1 is a top view of a first embodiment of a fan blade in accordance with the present invention.
Figure 2:
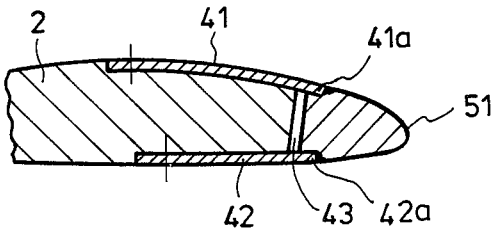
FIG. 2 is a sectional view, on enlarged scale, taken along the line II—II of FIG. 1.

Referring first to FIGS. 1 and 2, a first embodiment of a fan blade in accordance with the present invention will be described. A fan blade 1 comprises a main body 2 made of steel or aluminum by a conventional manner. The main body 2 has a leading edge 3 covered with leading edge cover means 4 which is securely joined to the main body 2 with suitable joint means 45 such as screws.

The leading edge cover means 4 is made of a stainless steel and comprises an upper-surface leading edge cover 41 and a lower-surface leading edge cover 42 formed in desired shapes, respectively, by the press forming process. The edge of the main body 2 is cut off along the whole length of the fan blade 1 to provide a notch 43 the width of which is substantially constant along the whole length of the fan blade 1.

A leading edge piece 51 is fabricated in a shape and length complemental with the shape and length of the notch 43. The base of the leading edge piece 51 is clamped by the leading edge covers 41 and 42 and is welded at its upper and lower surfaces to the leading edge portions 41*a* and 42*a* of the covers 41 and 42. The leading edge piece 51 is made of, for example, a hard sintered body of a metallic boron, a sintered body of a metal carbide such as tungsten carbide or a sintered body of a inorganic oxide such as alumina. It is preferable to use a welding such as an electron beam welding process so that the regions of the front edge covers and the leading edge piece which are affected by heat of welding may by minimized. Then, welded metals extended upwardly and downwardly along the welding line are removed by polishing and, as need demands, the leading edge covers 41 and 42 and the leading edge piece 51 plated with hard chrome.

The leading edge cover means 4 to which is securely joined the leading edge piece 51 in the manner described above is fitted over the leading edge 3 of the blade main body 2 and is securely joined thereto with suitable joint means 45 such as screws. Thus the fan blade 1 is provided.

Figure 3:
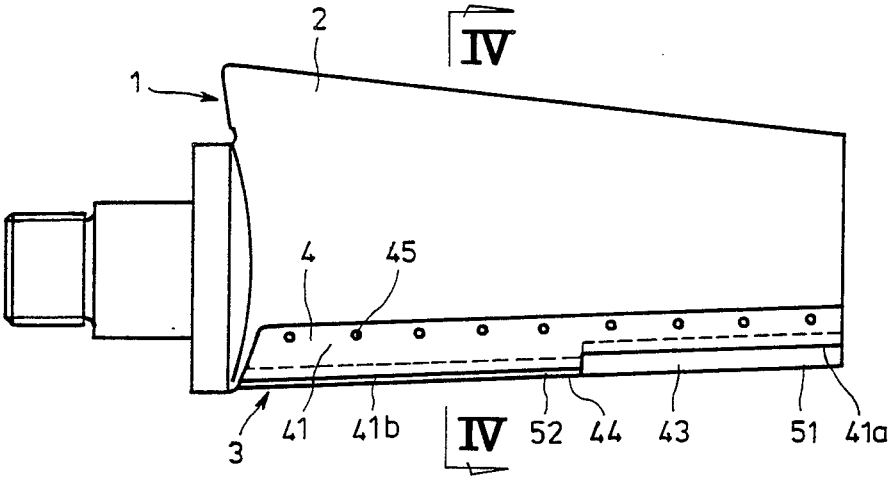
FIG. 3 is a top view of a second embodiment of a fan blade in accordance with the present invention.
Figure 4:
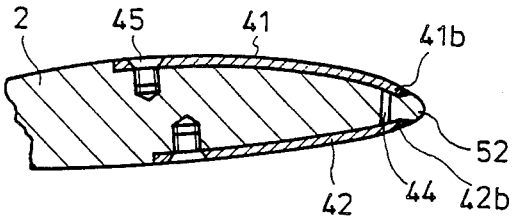
FIG. 4 is a sectional view, on enlarged scale, taken along the line IV—IV OF FIG. 3.
Figure 5:
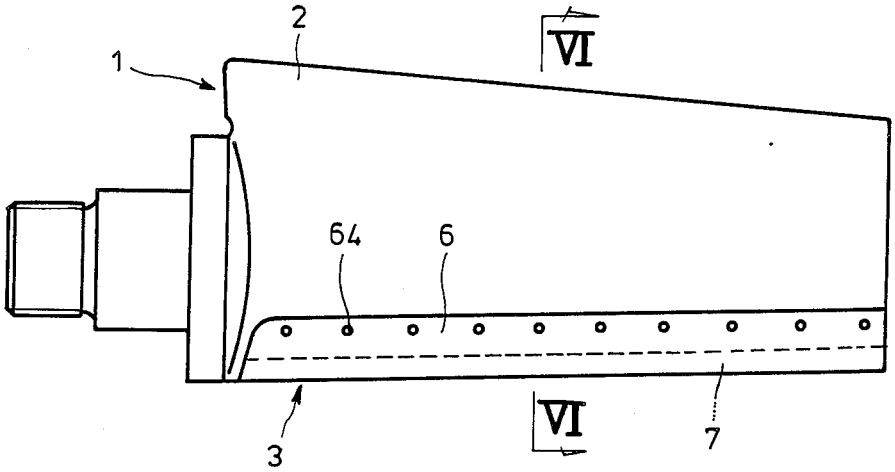
FIG. 5 is a top view of a third embodiment of a fan blade in accordance with the present invention.

FIGS. 3 and 4 show a second embodiment of the present invention in which the edge of the main body 2 is cut off along the length of about ¾-¼ of the whole length of the fan blade 1 from the tip thereof to provide a wide notch 43. The remaining leading edge portion is formed with a narrow notch 44.

Leading edge pieces 51 and 52 are fabricated in shapes and lengths complemental with the shapes and lengths of the corresponding notchs 43 and 44, respectively. The base of the leading edge piece 51 covering the wide notch 43 is welded at its upper and lower surfaces to the leading edge portions 41*a* and 42*a* of the cover 41 and 42 as is the case with the first embodiment (See FIG. 2).

The base of the leading edge piece 52 is also clamped between the leading edge covers 41 and 42 and is welded at its upper and lower surfaces to the leading edges 41*b* and 42*b* of the leading edge covers 41 and 42.

The leading edge piece 52 having a predetermined shape is fabricated by cutting a stainless steel rod. In welding the front edge piece 52 with the front edge covers 41 and 42, the leading edge piece 52 of a predetermined shape is placed in the notch 44 defined between the leading edge covers 41 and 42 so that the surfaces of the front edge covers 41 and 42 smoothly merge with the surface of the leading edge piece 52. Thereafter, the leading edge piece 52 is welded to the leading edges 41*b* and 42*b* of the leading edge covers 41 and 42.

The leading edge cover means 4 to which are securely joined the leading edge pieces 51 and 52 in the manner described above is fitted over the leading edge 3 of the blade main body 2 and is securely joined thereto with suitable joint means 45 such as screws. Thus the fan blade 1 is provided.

In the second embodiment as described, the front edge pieces are made of different materials. Alternatively, both of them may be made of hard sintered products.

Rerferring next to FIGS. 5 through 8(*c*), a third embodiment of a fan blade in accordance with the present invention will be described. The main body 2 of the fan blade 1 is made of steel or alminum as is the case with the first and second embodiments and the leading edge 3 of the fan blade 1 is fitted with leading edge cover manes 6 securely joined to the main body 2 with suitable joint means 64 such as screws.

Figure 7:
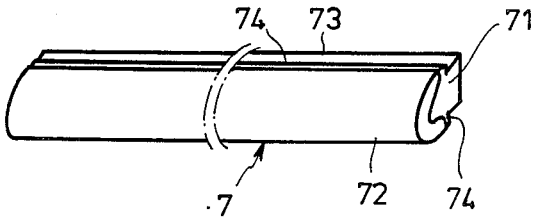
FIG. 7 is a perspective view showing a leading edge piece for the leading edge in the third embodiment.

The leading edge cover means 6 is made of stainless steel and comprises an upper surface leading edge cover 61 and a lower-surface leading edge cover 62 formed separately in desired shapes as is the case with the first embodiment. The edge of the main body 2 is cut off along the whole length of the fan blade 1 from the tip thereof to provide a notch 63. As shown in FIG. 7, a base member 71 of a leading edge piece 7 is securely joined to the edges defining the notch 63, whereby the leading edge 3 is provided.

An edge complemental portion 72 of a leading edge piece 7 is so fabricated as to have the same cross sectional configuration with the leading edge 3 of the main body 2 and so as to complement the notch 63. The edge complemental portion 72 is made of, for instance, a hard sintered body of a metallic boron, a sintered body of an inorganic oxide such as alumina or a sintered body of metal oxides such tungensten carbide. In compacting and sintering the powders, the edge complemental portion 72 is welded or diffusion joined to the previously fabricated stainless steel base member 71.

The leading edge piece 7 is fitted into the notch 62 such that the base 73 of the base member 71 is clamped by the leading edge covers 61 and 62. The edges 61*a* and 62*a* of the leading edge covers 61 and 62 and the bevelings 74 of the base member 71 are abutted against each other and welded together. In this case it is preferable to employ a welding method such as an electron beam welding process which will not adversely affect the welded regions of the leading edge covers 61 and 62 and the base member 71 because deformations resulting from the welding is minimized.

Thereafter the welded metals extended upwardly and downwardly along the welded lines are removed by polishing and preferably a surface layer 8 having a high degree of resistance to wear is formed by, for example, plating of hard chrome. Under some operation conditions, the surface layer 8 may be eliminated.

The leading edge 3 having the leading edge covers 61 and 62 and the leading edge piece 7 joined integrally is fitted over the main body 2 which is previously cut so as to be complemented by the leading edge piece 7 and then is securely joined to the main body 2 with suitable joint means 64 such as screws.

Figure 8A:
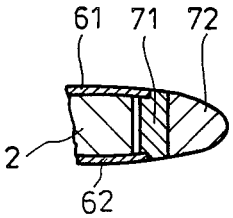
FIGS. 8(*a*), 8(*b*) and 8(*c*) are sectional views illustrating some combinations of a hard sintered leading edge member, a base and a leading edge cover in the third embodiment.
Figure 8B:
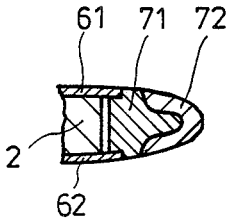
Figure 8C:
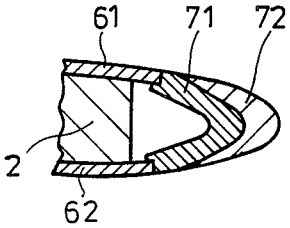
Figure 9:
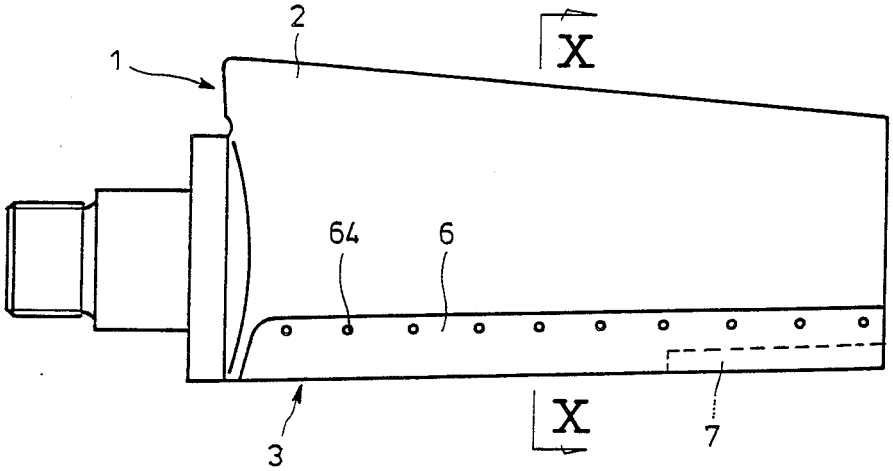
FIG. 9 is a top view of a fourth embodiment of a fan blade in accordance with the present invention.
Figure 10:
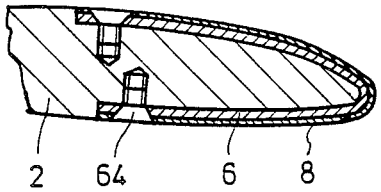
FIG. 10 is a partial sectional view, on enlarged scale, taken along the line X—X of FIG. 9.
Figure 11:
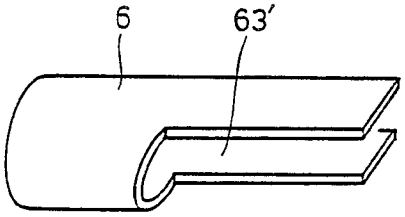
FIG. 11 is a perspective view showing a notched portion on the tip of a leading edge cover in the fourth embodiment.
Figure 12:
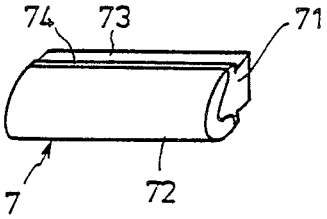
FIG. 12 is a perspective view showing a leading edge piece complementarily attached to the notched portion shown in FIG. 11.

The simplest is the case that one surface of the base member 71 is joined to the opposing flat surface of the edge complemental portion 72 as shown in FIG. 8(*a*); but in this case, there arises the problem that the volume of the edge complemental portion 72 is increased so that the cost of a sintered body from which the edge complemental portion 72 is fabricated becomes expensive.

The shape of the base member 71 as shown in FIG. 8(*b*) can decrease the volume of the edge complemental portion 72; but care must be taken so as to securely join between the base member 71 and the edge complemental portion 72. FIG. 8(*c*) shows a case in which the stainless steel base member 71 is bent so that the costs of materials can be reduced. Alternatively, the base portion 71 may be formed by sintering stainless steel powder simultaneous with the hard sintering of the edge complemetal portion 72.

Also in the arrangement shown in FIG. 8(*a*), 8(*b*) or 8(*c*), the leading edge piece and the leading edge covers may be plated with hard chrome. The layer formed by plating hard chrome has excellent resistance to wear, but the thickness of the plated layer is limitative. So, alternatively, a sintered body whose resistance to wear is substantially equal to or next to the hard chrome plated layer may be used as a leading edge, which will sufficiently prolong a useful life of the fan blade.

It is extremely difficult to cut a sintered body into an edge complemental portion 72. So, suitable powder is compacted into a desired shape and then sintered for production of an edge complemental portion. A high degree of joint strength can be attained when the leading edge portion is diffusion sintered with the base member or when the leading edge portion and the base member are simultaneously sintered.

Figure 6:
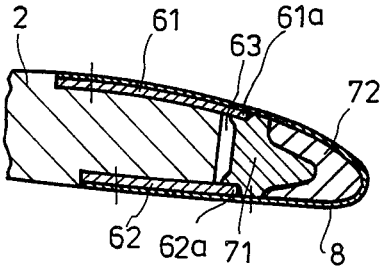
FIG. 6 is a sectional view on enlarged scale, taken along the line VI—VI of FIG. 5.

FIGS. 9 to 12 show a fourth embodiment of the present invention. While the notch 63 in the third embodiment extends over the whole length of the leading edge cover means 6, a notch 63' (See FIG. 11) according to the fourth embodiment extends over $\frac{3}{4}$–$\frac{1}{4}$ portion of the leading edge 3 from the tip thereof which is subjected to rapid wear. An edge complemental portion 72 for the notch 63' is of the same structure and is made of the same material as that shown in FIG. 7, but is short in length than the latter. The edge complemental portion 72 is attached at its base member 71 to the leading edge 3 for complement of the notch 63'. The cross sectional configuration at the notch 63' is the same as that at the notch 63 as shown in FIG. 6.

The fact that the substantially $\frac{3}{4}$–$\frac{1}{4}$ portion of the leading edge from a tip thereof is reinforced is on one hand because the tip of the leading edge is more severely worn than the remaining portion thereof since the former is faster in peripheral velocity than the latter and on the other hand serves for minimization of the load added to form the fan blade due to the centrifugal force.

As described above, according to the present invention, the leading edge piece made of a hard sintered product is securely attached to the leading edge of the blade main body along the length of about $\frac{3}{4}$–$\frac{1}{4}$ of the whole length thereof. As a result, even when the fan is used to discharge or move the abrasive gases containing dust, a useful life of the blades can be prolonged.

Furthermore, the stainless-steel covers are attached to the base of the leading edge piece so that wear proceeds uniformly along the whole length of the leading edge of the fan blade, whereby a useful life of the fan blade is further improved and deterioration in performance of the fan blade is averted.

What is claimed is:

1. In a blade for an axial fan comprising a main body having a leading edge fitted with anti-wear leading edge cover means, the improvement comprising a notch which is defined by cutting off said leading edge along a length about $\frac{3}{4}$–$\frac{1}{4}$ of a whole length of the leading edge from the tip thereof, said main body having a flat surface adjacent to said notch and a leading edge piece made of stainless steel and having an edge cross sectional configuration substantially the same as that of the remaining uncut-off portion of the main body adjacent to said notch and being attached to said main body at said notch, said leading edge piece having a shape of the forwardmost part of an axial fan leading edge, said leading edge piece comprising a base member made of stainless steel and having a flat surface, an edge complemental portion made of hard sintered body and securely attached to said flat surface of said base member, said leading edge piece being securely fitted to said main body adjacent to said notch.

2. A blade according to claim 1 including a hard chrome plating on said leading edge cover means and an outer surface of said leading edge piece.

3. A blade for an axial fan comprising;

a main body having a leading edge portion, an upper surface and a lower surface, the endmost portion of said leading edge portion being removed to define a flat forward edge of sain main body, a first notch defined in said upper surface and a second notch defined in said lower surface;

an upper surface cover shaped to have the shape of said main body upper surface at said leading edge portion;

a lower surface cover shaped to have the shape of said main body lower surface at said leading edge portion;

a leading edge piece which is conically shaped to form the forwardmost edge of said leading edge portion;

said upper and lower surface covers extending forwardly past said main body flat forward edge and being attached to said main body in said first and second notches respectively, to smoothly merge with said main body upper and lower surface respectively;

said leading edge piece being attached to said upper and lower surface covers and spaced from said main body flat forward edge to define a gap between said leading edge piece and said main body, said leading edge piece cooperating with said upper and lower surface covers to define a leading edge profile for an axial fan blade which is fluid mechanically efficient.

4. The blade defined in claim 3 wherein said leading edge piece is attached to said upper and lower surface covers by welding.

5. The blade defined in claim 4 wherein said upper and lower covers are attached to said main body by screws.

6. The blade defined in claim 4 wherein said flat forward edge extends for $\frac{3}{4}$–$\frac{1}{4}$ of the axial length of said main body.

7. The blade defined in claim 4 wherein said upper surface cover and said lower surface cover are attached together to form a monolithic element, said monolithic element having a notch defined therein adjacent to said main body flat forward edge.

8. The blade defined in claim 7 wherein said leading edge piece includes an edge complemental portion adapted to be received in said monolithic element notch.

9. The blade defined in claim 8 wherein said leading edge piece further includes a base member, said complemental portion being shaped to form said leading edge profile and having a notch defined therein, said base member having a shoulder adapted to abut said monolithic element adjacent to said monolithic element notch and being shaped to be accommodated in said complemental portion notch.

10. The blade defined in claim 9 wherein said monolithic element is shaped to form said leading edge profile at locations adjacent to and shaped from said monolithic element notch.

11. The blade defined in claim 10 wherein said edge complemental portion forms a continuation of said monolithic element leading edge profile shape.

12. The blade defined in claim 11 wherein said monolithic element abuts said main body at all locations common to said element and to said main body except adjacent to said main body flat forward edge.

* * * * *